US005735674A

United States Patent [19]

Domagalla et al.

[11] Patent Number: 5,735,674

[45] Date of Patent: Apr. 7, 1998

[54] LIQUID-RING GAS PUMP

[75] Inventors: Klaus Domagalla, Nutteln; Udo Segebrecht, Heiligenstedten, both of Germany

[73] Assignee: SIHI GmbH & Co KG, Itzehoe, Germany

[21] Appl. No.: 727,640

[22] PCT Filed: Apr. 18, 1995

[86] PCT No.: PCT/EP95/01433

§ 371 Date: Oct. 15, 1996

§ 102(e) Date: Oct. 15, 1996

[87] PCT Pub. No.: WO95/29340

PCT Pub. Date: Nov. 2, 1995

[30] Foreign Application Priority Data

Apr. 20, 1994 [DE] Germany ..... 9406597 U

[51] Int. Cl.[6] ..... F04C 19/00

[52] U.S. Cl. ..... 417/68; 417/69

[58] Field of Search ..... 417/68, 69

[56] References Cited

U.S. PATENT DOCUMENTS

| | | | |
|---|---|---|---|
| 1,668,532 | 5/1928 | Stewart . | |
| 3,209,987 | 10/1965 | Jennings . | |
| 3,713,749 | 1/1973 | Fitch . | |
| 3,884,596 | 5/1975 | Hoffmeister | 417/68 |
| 3,894,812 | 7/1975 | Huse | 417/68 |
| 4,498,844 | 2/1985 | Bissell et al. | 417/68 |
| 4,755,107 | 7/1988 | Trimborn | 417/68 |
| 4,817,265 | 4/1989 | Trimborn | 29/527.6 |
| 5,489,195 | 2/1996 | Domagalla et al. | 417/68 |

FOREIGN PATENT DOCUMENTS

| | | |
|---|---|---|
| 1 903 887 | 11/1969 | Germany . |
| 1 257 345 | 12/1971 | Germany . |
| 70 17 341 | 4/1973 | Germany . |
| 42 29 017 A1 | 3/1994 | Germany . |
| 230129 | 12/1943 | Switzerland . |

*Primary Examiner*—Charles G. Freay
*Attorney, Agent, or Firm*—Alix, Yale & Ristas, LLP

[57] ABSTRACT

Liquid-ring gas pump with a working space containing an overhung impeller (17) and a connection casing (2) which is separated from the working space by a control plate (13). This casing contains, on one side of a hub space (11) suitable for the accommodation of a mechanical seal (12), an inlet space (5) and, on the other side, a discharge space (6). The discharge space is connected to the working space to allow the recirculation of recirculated liquid. The connection between the discharge space and the working space is passed via the hub space. The hole (19) connecting the discharge space to the hub space is expediently situated on an extension (18) of the discharge space (6), the said extension leading across to the side of the pump containing the inlet space.

8 Claims, 1 Drawing Sheet

LIQUID-RING GAS PUMP

In a liquid-ring gas pump, the liquid ring circulating in the working space with the impeller takes part in the compression of the gas enclosed in the impeller cells. During this process, the inner surface of the liquid ring is brought close to the discharge opening through which the gas passes out of the working space into the discharge space, and mixing of the gas and the liquid also takes place to a certain extent. It is therefore unavoidable that operating liquid will pass continuously from the working space into the discharge space and will thereby be lost from the liquid ring. This loss of operating liquid is compensated in part by supplying fresh liquid and otherwise by recirculating liquid from the discharge space into the working space as "recirculated liquid". To this end, adequately dimensioned passages are provided in that part of the casing which contains the discharge space. This part of the casing also forms the connections and for this reason is referred to below as the connection casing. Within a hub space provided for the purpose, this connection casing can also contain the mechanical seal, which must be lubricated and cooled during operation. In the prior art, this is achieved by passing the fresh liquid through the hub space or by diverting a part stream out of the liquid ring, passing it via the mechanical seal and returning it to the working space on the inlet side (DE-U-7017341).

The object on which the invention is based is to reduce the requirement for fresh liquid or simplify the routing of the liquid. It achieves this by virtue of the the fact that the recirculated liquid should be used to lubricate the mechanical seal and, to achieve this, the connection for the recirculation of the returned liquid is passed out of the discharge space into the working space via the hub space. In comparison with those known pumps in which the mechanical seal is lubricated by means of fresh liquid, this has the advantage that the part of the liquid situated in the discharge space which is used as a cooling flow reduces the requirement for fresh liquid and that the cooling of the seal is not dependent on the continuous supply of fresh liquid. This can therefore be reduced and does not need to be maintained continuously. Compared with the abovementioned known pump, in which the cooling is carried out by means of a stream diverted specially for this purpose from the liquid ring, this has the advantage of simplification.

In the case of another known pump (DE-A-1903887), the space containing the seal is connected to the working space by a passage through which liquid can both flow in and out, i.e. can be exchanged. Admittedly, the seal space is also connected to the working space via an impeller gap; however, since this gap is to be sealed off as far as possible, it is not sufficient for the return of the recirculating liquid.

It has been found that the fear that the unavoidable gas content of the recirculated liquid in the discharge space could interfere with cooling is unfounded if the recirculated livid is taken from the discharge space at a point at which the liquid is in a calmed state and the gas content has largely separated out. According to the invention, this can be guaranteed particularly if the discharge space is provided, for the removal of the recirculated liquid, with an extension which leads from the discharge space to that side of the pump which contains the inlet space. On the one hand, the very length of the liquid path created by the extension of the discharge space gives greater surety that the recirculated liquid will be calm and free from gas bubbles. On the other hand, taking the extension to that side of the pump which contains the inlet space involves a largely horizontal course of the extension which permits good separation of any gas which the liquid may still contain before it reaches the hole leading from the extension to the hub space. If the pump is set up with the shaft horizontal, the extension should, in other words, lead to the opposite side of the vertical diameter of the pump, preferably underneath the hub space because the amount of gas in the liquid is less in the lower part of the discharge space than in the upper part. This mode of construction also has the advantage of being very simple.

The role of the discharge-space extension in calming the recirculated liquid requires that the cross-section of the discharge-space extension should be large relative to the cross-section of the hole leading into the hub space and the cross-section of the flow paths leading from the hub space into the working space.

The invention is explained below in greater detail with reference to the drawing, which illustrates schematically an advantageous exemplary embodiment. In the drawing.

Figure 2:
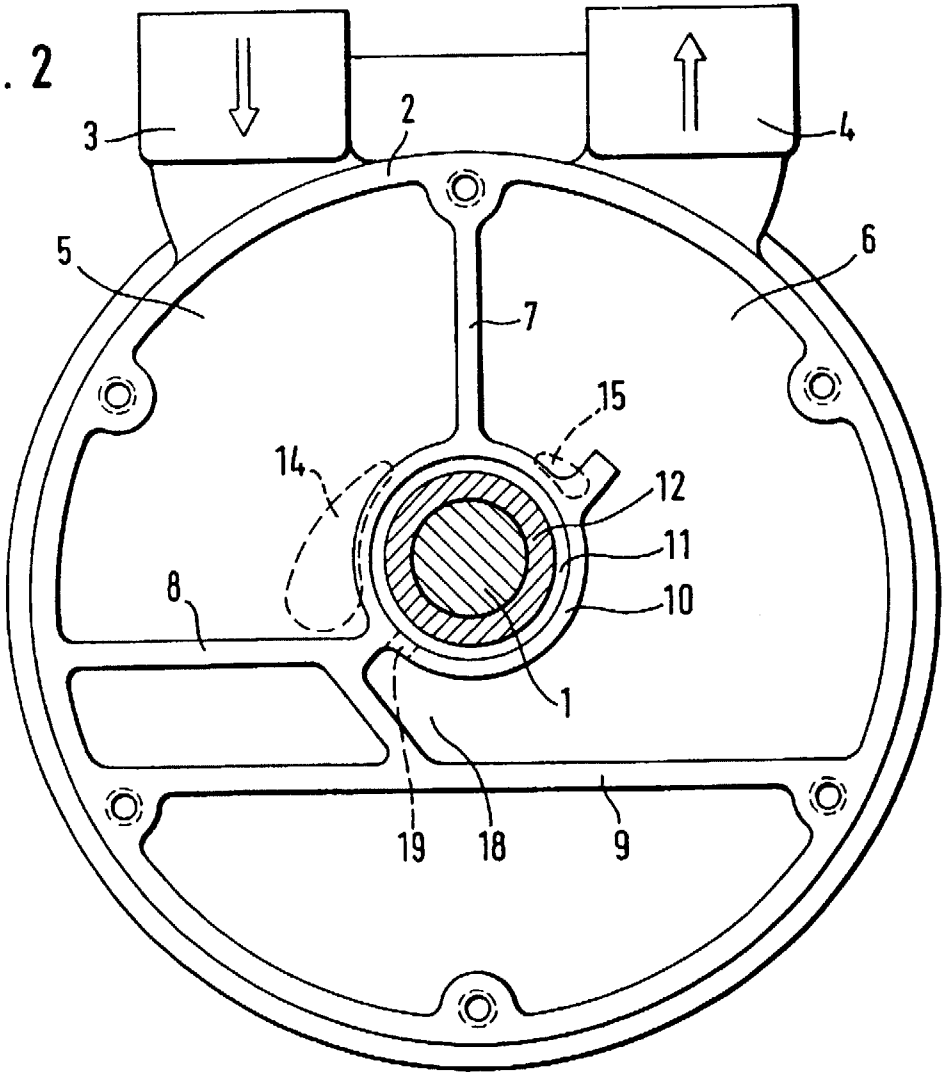
FIG. 2 shows a plan view of the connection casing from the direction of the control plate.
Figure 1:
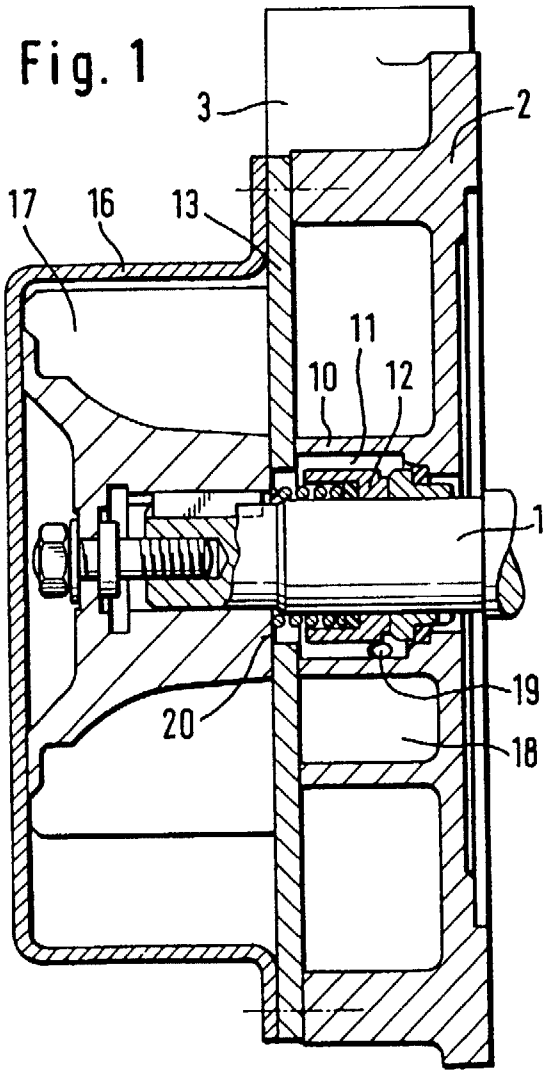
FIG. 1 shows a longitudinal section through the liquid-ring gas pump.

The shaft 1 of the pump is overhung in a motor or bearing pedestal (not shown) which is flanged to the connection casing 2. The connection casing forms the inlet connection 3 and the discharge connection 4, which are connected within the casing to the inlet space 5 and the discharge space 6. With the pump set up horizontally, they are separated from one another at the top by a wall 7 extending approximately vertically. At the bottom, they are bounded by walls 8 and 9. In the centre, they are bounded by an annular wall 10 which encloses a hub space 11 in which a mechanical seal 12 is accommodated.

These spaces are closed at the end by a control plate 13 which contains an inlet opening 14 in the region of the inlet space 5 and one or more discharge openings 15 in the region of the discharge space. On the other side of the control plate 13, a cup-shaped working-space casing 16 encloses the working space, in which the impeller 17 revolves eccentrically on the shaft 1. The liquid ring revolving eccentrically in the working space relative to the impeller leads to a periodic enlargement (inlet side) and reduction (discharge side) in the free volume of the impeller cells and thereby brings about the delivery of the gaseous medium, which is sucked out of the inlet space 5 through inlet openings 14 and expelled into the discharge space 6 through the discharge opening 15 together with part of the operating liquid.

Branching off from the lower region of the discharge space 6 is a discharge-space extension 18 which leads across, underneath the hub space 11, to the other side of the connection casing. In this context, "the other side" should be taken to mean the side which is separated from the discharge-space side by the diameter defined by the wall 7 which separates the discharge space from the inlet space in the upper region. Instead, it is also possible to settle on the vertical diameter, which in the present example coincides with the diameter defined by the wall 7.

A hole 19 is provided in the wall 10 in the region of the extension 18 remote from the discharge space and the recirculated liquid can cross through this hole from the discharge space 6 to the hub space 11. It is expediently arranged in such a way that it points at the area of the mechanical seal to be cooled in order, on the one hand, to intensify the cooling there and, on the other hand, to flush away gas bubbles which may be adhering there. After the recirculated liquid has flowed through the hub space 11, it passes through the shaft hole provided in the control plate 13 to the end face 20 of the hub of the impeller 17 and flows—predominantly on the inlet side—between the said end face and the control plate 13 into the working space.

This function is guaranteed irrespective of whether the pump is used as a vacuum pump or as a compressor since, in either case, the hub space 11 is under a pressure which is not significantly lower than the pressure prevailing in the discharge space 6, while, in the working space, at least a circumferential area is at a lower pressure level.

We claim:

1. A liquid-ring gas pump comprising a working space casing (16) defining a working space and containing an overhung impeller (17), a connection casing (2) comprising an inlet chamber (5) and a discharge chamber isolated from the inlet chamber, a shaft for driving said impeller within said working space, a mechanical seal on said shaft and a wall spaced from said seal to define a hub space (11) therebetween for receiving cooling fluid therein, a control plate (13) separating said working space from said inlet and outlet chambers the discharge chamber (6) being fluidly connected to the hub space (11) to allow the recirculation of liquid between the discharge chamber (6) and the working space via the hub space (11).

2. Liquid-ring gas pump according to claim 1, wherein said discharge chamber includes an extension (18) and said fluid connection for recirculation includes a hole (19) connecting said extension of the discharge chamber (6) to the hub space (11), the extension projecting across to the side of the pump containing the inlet chamber.

3. Liquid-ring gas pump according to claim 2, wherein, when the pump is set up with the shaft horizontal, the hole (19) lies beyond the vertical diameter of said casing as viewed from the discharge chamber.

4. Liquid-ring gas pump according to claim 3, wherein the extension (18) of the discharge chamber (6) lies generally vertically below the hub space (11).

5. The liquid-ring gas pump according to claim 1, wherein said connection casing includes a discharge connection (4) communicating with the discharge chamber and said chamber includes an extension portion (18) remote from said discharge connection, said fluid connection for recirculation being positioned in said extension portion.

6. The liquid-ring gas pump according to claim 5, wherein said fluid connection for recirculation includes a hole (19) connecting the discharge chamber (6) to the hub space (11).

7. The liquid-ring gas pump according to claim 6, wherein the hole (19) lies immediately adjacent the inlet chamber.

8. The liquid-ring gas pump according to claim 5, wherein the extension portion (18) of the discharge chamber (6) lies on the opposite side of the hub space (11) from the discharge connection.

* * * * *